United States Patent [19]

Kowal et al.

[11] B 3,982,563

[45] Sept. 28, 1976

[54] CLAMP-ON VALVE STRUCTURE

[75] Inventors: Leonard J. Kowal, Prospect Heights; Robert C. Gibson, Chicago, both of Ill.

[73] Assignee: Imperial-Eastman Corporation, Chicago, Ill.

[22] Filed: Jan. 2, 1974

[21] Appl. No.: 430,172

[44] Published under the second Trial Voluntary Protest Program on January 13, 1976 as document No. B 430,172.

[52] U.S. Cl. ..... 137/798; 141/329; 220/85 R; 222/89; 285/81; 285/320

[51] Int. Cl.[2] ..... B67B 7/24

[58] Field of Search ..... 137/798; 141/329, 330, 141/384, 386; 220/85 R, 85 V; 222/5, 89; 285/81, 320

[56] References Cited

UNITED STATES PATENTS

| | | | |
|---|---|---|---|
| 2,981,439 | 4/1961 | Huffman | 220/85 R |
| 3,092,291 | 6/1963 | Franck | 222/89 X |
| 3,777,789 | 12/1973 | Corlet | 285/320 X |
| 3,850,452 | 11/1974 | Strybel | 285/38 |

*Primary Examiner*—Alan Cohan
*Assistant Examiner*—Gerald A. Michalsky
*Attorney, Agent, or Firm*—Hofgren, Wegner, Allen, Stellman & McCord

[57] ABSTRACT

A clamp-on valve structure for use in dispensing pressurized fluid from a can having an annular projecting lip. The valve structure includes mounting structure having a manipulatable portion which is effectively locked to prevent removal of the valve structure from the can with the valve installed on the mounting structure.

21 Claims, 8 Drawing Figures

CLAMP-ON VALVE STRUCTURE

BACKGROUND OF THE INVENTION

1. Field of the Invention

This invention relates to fluid flow control devices, and in particular to clamp-on valve structures for use in controlling fluid delivery from a container of pressurized fluid.

2. Description of the Prior Art

In one improved form of can tapping device disclosed in U.S. Pat. No. 3,092,291 of George E. Franck, owned by the assignee hereof, three lugs are provided on a mounting bracket for engaging at substantially 90° spaced positions, an upstanding lip portion of a pressurized fluid can. A valve is threadedly mounted to an internally threaded mounting portion of the mounting bracket to engage a wall portion of the can centrally of the upstanding lip and permit tapping of the can portion to provide valve controlled delivery of fluid from the can. The present invention is concerned with a further improvement in such a can tapping device.

Other prior art patents of pertinency to the present invention include U.S. Pat. No. 2,807,391 of George T. Wrenn, Jr., which similarly provides three inturned fingers, or lugs, for engaging the can lip at three substantially 90° spaced positions. In U.S. Pat. No. 2,853,126 of Gabriel F. Corlet, spring clips are provided for elastically retaining the valve to the subjacent container.

In Russell I. Huffman U.S. Pat. No. 2,981,439, a coupling for a gas appliance is shown having a latch member pivotally mounted to a frame member and utilizing a detent structure for releasably maintaining the latch member in the clamping position with the detent being separable from the cooperating recess by a simple swinging of the latch member on the pivot through the fingertip manipulating portion thereof. Huffman requires an annular flange for centering the frame member on the upper portion of the can lip in addition to spaced, fixed lugs flange means cooperating with a lug flange means on the latch member.

Anthony Willats, in U.S. Pat. No. 3,106,317, shows a can handling device with a hook portion on the handle means. In U.S. Pat. No. 3,580,424 of Virgil Philipps, a dispensing valve for use with a pressurized can of fluid includes a movable disclike member rotatable about the axis of an upstanding annular flange portion of a cooperating disclike member. Relative movement between the two disclike members is permitted at all times between clamping and released positions defined by the permitted movement of a pin in a sector of the fixed disclike member.

Additional prior art United States Letters Patent showing other forms of pivotal connecting elements are those of:

| | |
|---|---|
| J. C. Schellin | 1,761,157 |
| W. S. Reed | 1,920,524 |
| O. E. Clark | 2,069,216 |
| R. W. Saxton | 2,565,269 |
| J. T. Krapp | 2,770,474 |
| R. T. Cornelius | 3,155,402 |

SUMMARY OF THE INVENTION

The present invention comprehends an improved clamp-on valve structure for use in dispensing pressurized fluid from a can having an annular projecting lip. The valve structure includes relatively movable valve mounting portions which, upon suitable manipulation, provide means for mounting a fluid control valve in fluid transfer association with a connecting portion of the can within the annular projecting lip portion.

The invention comprehends an arrangement of the mounting structure which effectively precludes inadvertent disassociation thereof from the can when the valve is installed by means of the mounting structure on the can.

More specifically, the invention comprehends arranging the mounting portions so that relative movement therebetween is effectively prevented by cooperating means on the relatively movable portions of the mounting structure and by a unique disposition of the movable portion of the mounting structure relative to the valve mounted on the mounting structure.

In the illustrated embodiment, the invention comprehends the provision of a clamp-on valve structure for use with a can of pressurized fluid having an annular, projecting lip encircling a connecting portion of the can, the valve structure including a mounting plate having a central opening defined by an internally threaded, annular valve mounting portion, lug means defining first and second lip engagement portions equiangularly spaced from a diametric centerline bisecting the annular portion to extend rearwardly of a diameter of the annular portion perpendicular to the centerline, and means defining a stop. The valve structure further includes a lever defining a pivot portion, a manipulating portion, a third lip engagement lug m means, and means defining a shoulder, and means pivotally connecting the pivot portion to the mounting plate rearwardly of the perpendicular diameter. A valve having a threaded mounting means is removably mounted to the threaded annular portion of the mounting plate and includes a portion extending into the path of pivotal movement of the lever, the lever being arranged to urge the pivot forwardly to force the first and second lug means clampingly against the container lip as an incident of the lever being swung to a clamping position wherein the third lug means is forced against the lip adjacent the forward and of the centerline, the lever shoulder abutting the mounting plate stop to prevent pivotal movement forwardly beyond the clamping portion, and the lever extending between the mounting plate stop and the valve portion to prevent pivotal movement rearwardly from the clamping position when the lever is swung to the clamping position and the valve is threaded to the mounting plate whereby the lever is effectively maintained in the clamping position to prevent accidental release of the clamp-on valve structure from the can lip.

The lever may include an arcuate mid-portion embracing the valve to prevent the undesirable rearward movement.

In the specific illustrated form of the invention, the pivotal connecting means is disposed on the centerline. Further in the specific illustrated embodiment, the lip-engaging portions of the lug means comprise separate lugs, each defining a forward edge adjacent the perpendicular.

The manipulating portion may be provided with a recess which slidably engages the periphery of the mounting plate to assist in guiding the lever in the pivotal movement thereof.

The threaded portion of the mounting plate to which the valve is connected may comprise an upstanding annular wall and the lever may be arranged to extend subjacent the mounting plate to swing across the central opening defined by the annular wall in securing the mounting structure to the can lip prior to threading of the valve to the mounting portion. The manipulating portion may extend laterally from the pivot and parallel to the centerline of the valve mounting portion when the lever is in the clamping position.

The clamp-on valve structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
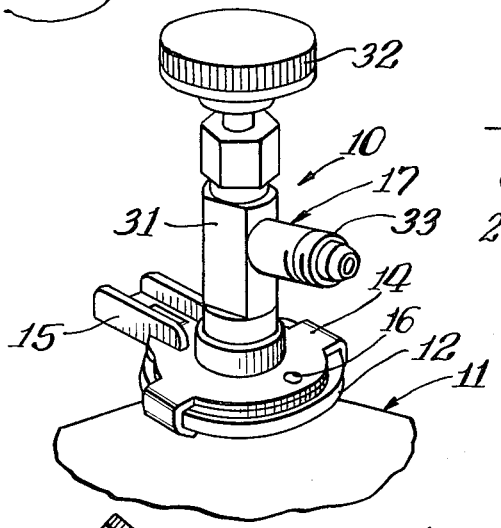
FIG. 1 is a perspective view of a clamp-on valve structure embodying the invention mounted on the lip portion of a pressurized fluid container.

In the exemplary embodiment of the invention as disclosed in the drawing, a clamp-on valve structure generally designated 10 is provided for use with a fluid container 11 herein comprising a can of pressurized fluid, having an annular projecting lip 12 encircling a connecting portion 13 of the can adapted to be pierced to provide fluid delivery from the can through the valve structure.

Valve structure 10 includes a mounting plate 14, a lever 15, means 16 pivotally interconnecting the lever and mounting plate, and a fluid flow control valve 17, all as illustrated in FIG. 1.

Mounting plate 14 includes a central opening 18 defined by an internally threaded annular valve mounting flange 19 upstanding from a disc-like body portion 20 of the mounting plate.

Figure 3:
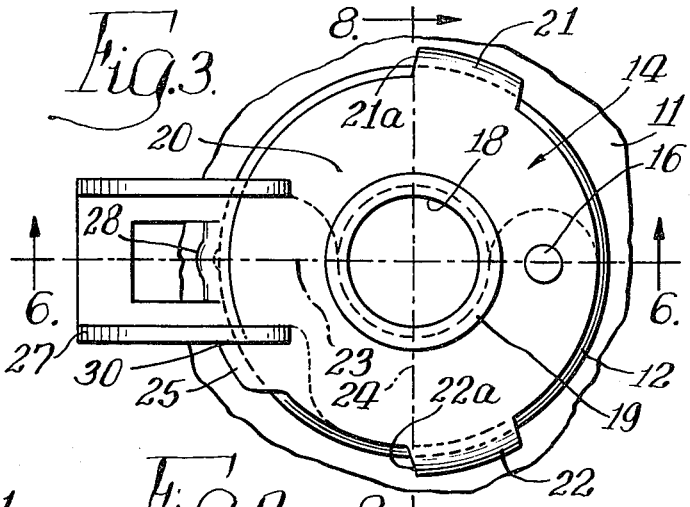
FIG. 3 is a view similar to that of FIG. 2 but with the valve structure arranged in the clamped arrangement.

The mounting plate is further provided with lug means defined by first lip engagement portion 21 and second lip engagement portion 22 equiangularly spaced from a diametric centerline 23 bisecting the annular connecting portion. As best seen in FIG. 3, the lug portions 21 and 22 comprise spaced lugs which extend rearwardly of a diameter 24 of the annular portion 19 perpendicular to the centerline 23, and in the illustrated arrangement, define forward edges 21*a* and 22*a*, respectively, at the diameter 24.

Mounting plate 14 further defines a stop 25 forwardly of the diameter 24 and adjacent the centerline 23, as shown in FIG. 3.

Figure 4:
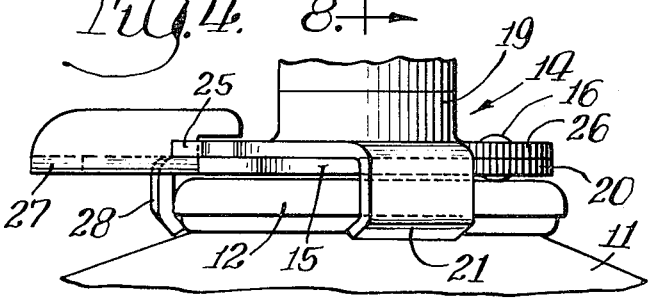
FIG. 4 is a fragmentary side elevation thereof with the valve connected thereto.

Lever 15 includes a pivot portion 26 at one end and a manipulating portion 27 at the opposite end. A third lip engaging lug means 28 depends from the manipulating portion 27, as best seen in FIG. 4. The lever further defines an arcuate mid-portion 29 and a shoulder portion 30 adapted to engage stop 25 when the lever is pivoted to the clamping position of FIG. 3.

Pivot 16 may comprise a suitable rivet extending through the lever portion 26 and the mounting plate portion 20 on centerline 23 rearwardly of perpendicular diameter 24, as shown in FIG. 3.

Figure 6:
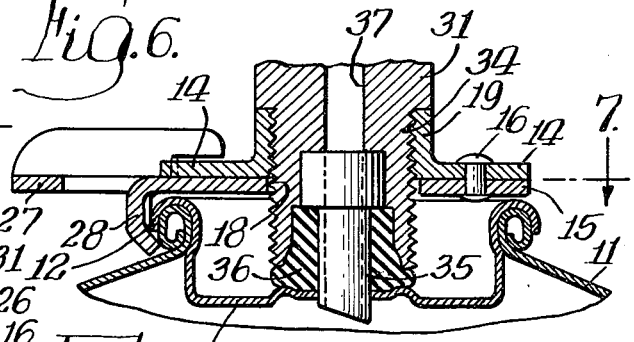
FIG. 6 is a vertical section taken substantially along the line 6—6 of FIG. 3.

Valve 17 comprises a manually operable fluid flow valve having a body portion 31, a suitably manually operable operating knob 32, threaded connection means 33 for threaded connection of a fluid receiver thereto, and a lower, externally threaded portion 34 adapted to be threaded through upstanding flange 19. As shown in FIG. 6, the lower end of the valve may be provided with a piercing element 35 adapted to be forced through can tapping portion 19 as an incident of threading of the valve portion 34 through clamp portion 19. A suitable sealing element 36 may be provided around piercing element 35 to seal the valve to can portion 13 to provide a sealed connection of the valve to the can and permit controlled flow of fluid from the can upwardly through a flow passage 37 in the valve body 31 and delivery through connection 33 as controlled by the adjustable means 32.

Figure 7:
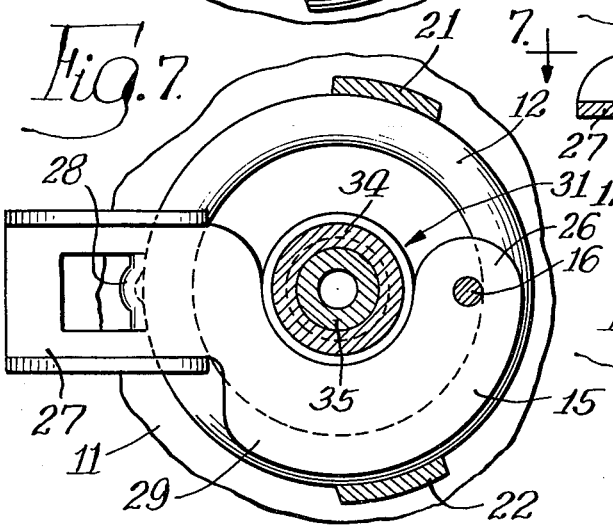
FIG. 7 is a horizontal section taken substantially along the line 7—7 of FIG. 6.

The present invention comprehends such an arrangement of the clamp-on valve structure whereby the body 31 of the valve synergistically provides, in connection with the lever portion 29, means for positively preventing backing off of the lever from the clamped position of FIG. 7 when the valve is installed on the mounting means as shown in FIGS. 1 and 7. In the clamped arrangement of the mounting structure, the manipulating portion 27 extends substantially parallel to the centerline 23 forwardly from the mounting plate 14 with the shoulder 30 of the manipulating portion substantially abutting the stop 25, as best seen in FIG. 3. In this arrangement, as shown in FIG. 7, arcuate portion 29 embraces the lower threaded portion 34 of valve body 31 and is prevented from moving in a clockwise direction, as shown in FIG. 7, by the valve body portion 34. Resultingly, the lever is positively locked in the clamping position with the valve body portion 34 preventing backward movement of the lever from the clamping position and the stop 25 preventing forward movement beyond the clamping position.

Figure 2:
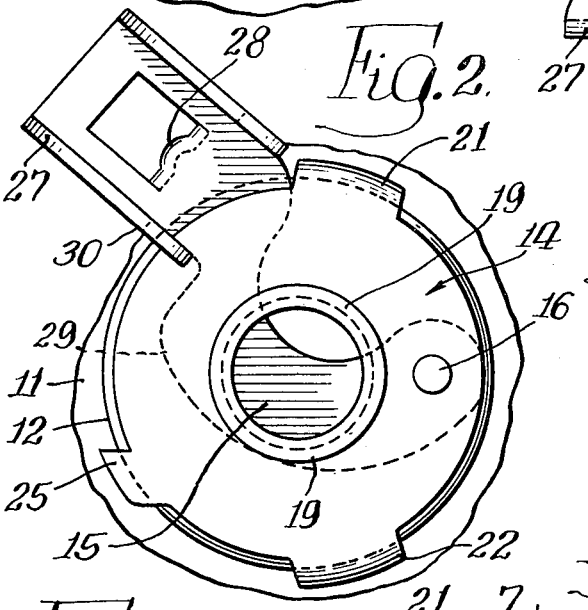
FIG. 2 is an enlarged top plan view of the mounting structure during a first step in the mounting of the valve structure on the pressurized fluid container.
Figure 5:
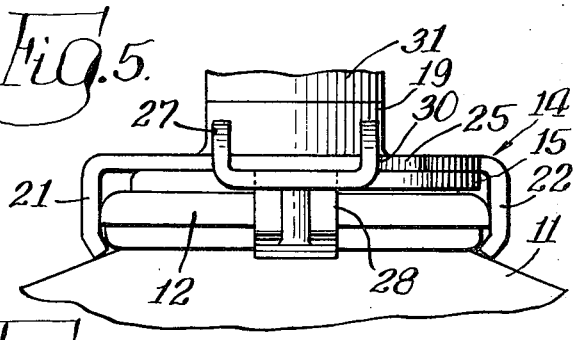
FIG. 5 is a left side elevation thereof.
Figure 8:
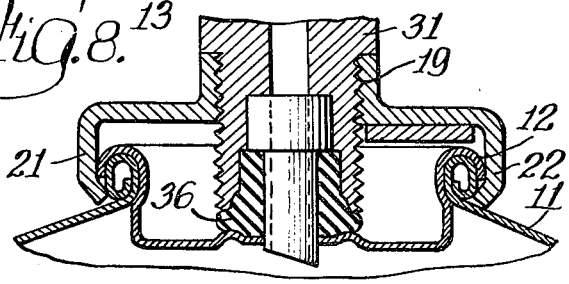
FIG. 8 is a vertical section taken substantially along the line 8—8 of FIG. 3.

As best seen in FIG. 6, lever 15 extends subjacent mounting plate 14 to swing across opening 18 in moving to and from the clamping position when the valve 10 is removed from the mounting structure. When the lever is swung from the position of FIG. 2 to the clamping position of FIG. 7, engagement of the lug 28 with the lip 12 pulls the pivot 16 forwardly along centerline 23 thereby forcibly urging the lugs 21 and 22 also forwardly against the lip 12 whereby the mounting structure is firmly clamped to the lip 12 by the inturned lugs 21, 22 and 28, as shown in FIGS. 6 and 8. Thus, the length of lever 15 from pivot 16 to lug 28 is preselected to provide the desired interference fit between lug 28 and lip 12 in the clamping arrangement of the mounting structure.

As discussed above, once the mounting structure is clamped to the can lip, valve 17 may be threadedly mounted thereon to provide the self-tapping fluid connection discussed above and fluid flow from the can through the valve controlled by suitable manipulation of knob 32 as desired. Upon emptying of the pressurized fluid from the can, the clamp-on valve structure 10 may be removed from the mounting structure by unthreading the valve body portion 34 from the threaded flange 19 whereupon lever 15 may be swung from the clamping position away from stop 25 to release the lugs from secured engagement with the can lip and permit facilitated withdrawal of the mounting structure from the can. The unthreading of the valve may be limited to that wherein the lower end of the valve, defined by the piercing element 35, is disposed within the threaded flange portion 19 of the mounting plate so that disconnection of the clamp-on valve structure from the can may be made without complete disassembly of the valve from the mounting structure for facilitated reuse thereof in connection with a subsequent fluid delivery operation.

The foregoing disclosure of specific embodiments is illustrative of the broad inventive concepts comprehended by the invention.

We claim:

1. A clamp-on valve structure for use with a can of pressurized fluid having an annular, projecting lip encircling a connecting portion of the can, said valve structure comprising: a mounting plate having a central opening defined by an internally threaded, annular valve mounting portion, lug means defining first and second lip engagement portions equiangularly spaced from a diametric centerline bisecting said annular portion to extend rearwardly of a diameter of said annular portion perpendicular to said centerline, and means defining a stop; a lever defining a pivot portion, a manipulating portion, a third lip engagement lug means, and means defining a shoulder; means pivotally connecting said pivot portion to said mounting plate rearwardly of said perpendicular diameter; and a valve having a threaded mounting means removably mounted to said threaded annular portion of the mounting plate and including a portion extending into the path of pivotal movement of said lever, said lever being arranged to urge said pivot forwardly to force said first and second lug means clampingly against the container lip as an incident of said lever being swung to a clamping position wherein said third lug means is forced against said lip adjacent the forward end of said centerline, said lever shoulder abutting said mounting plate stop to positively prevent pivotal movement beyond said clamping position, said lever extending between said mounting plate stop and said valve portion to positively prevent pivotal movement of the lever forwardly from said clamping position when said lever is swung to said clamping position and said valve is threadedly mounted to said mounting plate.

2. The clamp-on valve structure of claim 1 wherein said lever includes an arcuate mid-portion having an angular extent of no more than 180° embracing said valve portion to prevent said pivotal movement backwardly from the clamping portion.

3. The clamp-on valve structure of claim 1 wherein said pivotally connecting means is on said centerline.

4. The clamp-on valve structure of claim 1 wherein said first and second lip engaging portions comprise spaced lugs each defining a forward edge adjacent said perpendicular diameter.

5. The clamp-on valve structure of claim 1 wherein said first and second lip engaging portions comprise spaced lugs each defining a forward edge lying on said perpendicular diameter.

6. The clamp-on valve structure of claim 1 wherein said lever defines recess means slidably embracing the peripheral edge of the mounting plate as the lever is swung on said pivotably connecting means adjacent said clamping position.

7. The clamp-on valve structure of claim 1 wherein said manipulating portion extends substantially parallel to said centerline when said lever is in said clamping position.

8. The clamp-on valve structure of claim 1 wherein said lever defines recess means slidably embracing the peripheral edge of the mounting plate as the lever is swung on said pivotably connecting means forwardly of said perpendicular diameter.

9. The clamp-on valve structure of claim 1 wherein said valve portion comprises an extension of said threaded means.

10. The clamp-on valve structure of claim 1 wherein said annular portion of the mounting plate comprises an upstanding annular wall thereon, and said lever extends subjacent said mounting plate for free pivotal movement across said central opening prior to mounting of the valve to said annular portion.

11. A clamp-on connector for use in sealingly connecting a valve having a male threaded mounting portion to a can of pressurized fluid having an annular, projecting lip encircling a connecting portion of the can, said connector comprising: a mounting plate having a central opening defined by an internally threaded, annular valve mounting portion, lug means defining first and second lip engagement portions equiangularly spaced from a diametric centerline bisecting said annular portion and disposed rearwardly of a diameter of said annular portion perpendicular to said centerline, and means defining a stop; a lever defining a pivot portion, a manipulating portion, a third lip engagement lug means, and means defining a shoulder; and means pivotally connecting said pivot portion to said mounting plate, said lever being arranged to urge said mounting plate forwardly to force said first and second lug means clampingly against the container lip as an incident of said lever being swung to a clamping position wherein said third lug means is forced against said lip adjacent the forward end of said centerline, said lever shoulder abutting said mounting plate stop to positively prevent pivotal movement of said lever beyond said clamping position at all times whereby the valve threaded mounting portion may be removably threaded to said threaded annular portion of the mounting plate to extend into the path of rearward pivotal movement of said lever and cooperate with said stop and shoulder abutment to positively prevent pivotal movement of the lever in either direction from said clamping position.

12. The clamp-on connector of claim 11 wherein said lever includes an arcuate mid-portion having an angular extent of no more than 180° embracing said valve portion to prevent said pivotal movement backwardly from the clamping portion.

13. The clamp-on connector of claim 11 wherein said pivotally connecting means is on said centerline.

14. The clamp-on connector of claim 11 wherein said first and second lip engaging portions comprise spaced lugs each defining a forward edge adjacent said perpendicular diameter.

15. The clamp-on connector of claim 11 wherein said first and second lip engaging portions comprise spaced lugs each defining forward edge lying on said perpendicular diameter.

16. The clamp-on connector of claim 11 wherein said lever defines recess means slidably embracing the peripheral edge of the mounting plate as the lever is swung on said pivotably connecting means adjacent said clamping position.

17. The clamp-on connector of claim 11 wherein said manipulating portion extends substantially parallel to said centerline when said lever is in said clamping position.

18. The clamp-on connector of claim 11 wherein said lever defines recess means slidably embracing the peripheral edge of the mounting plate as the lever is swung on said pivotably connecting means forwardly of said perpendicular diameter.

19. The clamp-on connector of claim 11 wherein said annular portion of the mounting plate comprises an upstanding annular wall thereon, and said lever extends subjacent said mounting plate for free pivotal movement across said central opening prior to mounting of the valve to said annular portion.

20. The clamp-on connector of claim 11 wherein said lever extends subjacent said mounting plate for free pivotal movement across said central opening prior to mounting of the valve to said annular portion.

21. The clamp-on connector of claim 11 wherein said lever extends subjacent said mounting plate for free pivotal movement across said central opening prior to mounting of the valve to said annular portion, a portion of said lever slidably overlying said mounting plate.

* * * * *